US005417384A

United States Patent [19]

Lindstrand

[11] Patent Number: 5,417,384

[45] Date of Patent: May 23, 1995

[54] TOOL FOR MOUNTING TO A PARCEL CONTAINING A COIL OF A CONTINUOUS, FLEXIBLE OBJECT

[75] Inventor: Ulf Lindstrand, Fengersfors, Sweden

[73] Assignee: Ulvator AB, Enkoping, Sweden

[21] Appl. No.: 142,321

[22] PCT Filed: Mar. 25, 1992

[86] PCT No.: PCT/SE92/00351

§ 371 Date: Nov. 22, 1993

§ 102(e) Date: Nov. 22, 1993

[87] PCT Pub. No.: WO92/21604

PCT Pub. Date: Dec. 10, 1992

[30] Foreign Application Priority Data

May 27, 1991 [SE] Sweden ..... 9101600-6

[51] Int. Cl.[6] ..... B65H 75/22

[52] U.S. Cl. ..... 242/557; 242/559; 242/607; 242/614

[58] Field of Search ..... 242/557, 559, 607, 607.2, 242/609.2, 609.3, 614

[56] References Cited

U.S. PATENT DOCUMENTS

| | | | |
|---|---|---|---|
| 1,905,488 | 4/1933 | Nack | 242/607 X |
| 2,662,701 | 12/1953 | Weber | 242/614 X |
| 3,652,026 | 3/1972 | Awebro . | |
| 4,572,370 | 2/1986 | Cedenblad et al. | 206/398 |
| 4,883,178 | 11/1989 | Thiele et al. | 206/391 |
| 4,895,316 | 1/1990 | Salloum | 242/607 X |
| 5,004,179 | 4/1991 | Salloum | 242/607 X |

FOREIGN PATENT DOCUMENTS

| | | |
|---|---|---|
| 2625990 | 7/1989 | France . |
| 2053848 | 2/1991 | United Kingdom . |
| WO91/16261 | 10/1991 | WIPO . |

*Primary Examiner*—Daniel P. Stodola
*Assistant Examiner*—John P. Darling
*Attorney, Agent, or Firm*—Nixon & Vanderhye

[57] ABSTRACT

A tool mounts a parcel containing a coil of a cable, for instance, a sleeve for the cable, and two protective rings at the sides of the coil, the tool having two wheel-shaped side supports including one larger and one smaller circle segment having opposite dividing edges, the circle segments being capable to be coupled and locked to each other. The side supports are provided with concentric centering elements to center the sleeve, the dividing edges being provided radially outside the centering elements of the side supports for dividing the distance between the centering element and the peripheral edge element in a ratio of from 1:1 to 1:3. The dividing edge of the larger circle segment is provided at a radial distance from the center of the side support that is less than the radius of the parcel.

20 Claims, 4 Drawing Sheets

TOOL FOR MOUNTING TO A PARCEL CONTAINING A COIL OF A CONTINUOUS, FLEXIBLE OBJECT

The present invention relates to a tool for mounting to a parcel to form a rotatable unit, said parcel containing a coil of a continuous, flexible object comprising cable, line, wire, wire cable, rope, cord, ribbon, hosing, chain or the like, an axially open cylindrical sleeve, around which the object is coiled, and two protective rings located at the sides of the coil, said tool comprising two identical wheel-shaped side supports consisting of one larger and one smaller circle segment, said circle segments having dividing edges facing each other, the circle segments including cooperating coupling means and cooperating locking means arranged at the dividing edges in order in operative position to fix the circle segments to each other in a common plane, whereby at least the locking means being arranged to be brought out of their operative positions to permit movement of the smaller circle segment from the larger circle segment.

SE-9101042-1 (corresponding to U.S. application Ser. No. 07/930,660, atty. ref. 268-33) the disclosure of which is incorporated by reference herein, describes a new system for handling cable and line, for instance, said handling starting with the manufacture of a coil of cable or line and enveloping the coil to form a parcel for delivery to a user. The coil is obtained by the cable or line being coiled onto an axially open, cylindrical sleeve. Before coiling is performed, the sleeve is provided with two flat, outer protective rings having concentric support surfaces cooperating with opposing internal or external surfaces of the sleeve, depending on the type of protective rings used. The sleeve is secured by a tool having two parallel side supports with concentric centering elements facing each other so that the sleeve is clamped between the side supports and is centered by their centering elements, a rotatable unit thus being formed. The cable or line is then attached to this unit which is caused to rotate in a coiling machine so that the cable or line is formed to a coil. The finished coil is surrounded by a protective casing, after which strong bands are passed through the sleeve, enclosing the sleeve and the protective rings, and tightened to form said parcel. The side supports are removed from the finished parcel to be used in the manufacture of further coils. The finished parcel is delivered in this state to a work place where a second tool is mounted onto the parcel to prepare for unwinding the cable or line. The second tool also has two parallel side supports with concentric centering elements facing each other. By clamping the parcel between the side supports and centering it by means of the centering elements, a second rotatable unit is formed which is then journalled for free rotation about a horizontal or vertical axis of rotation in a special uncoiling device. When the bands have been cut and the protective casing removed, the cable or line is exposed ready for uncoiling. According to one embodiment the second tool is provided with a connecting means consisting of a hollow shaft and a hollow locking device. The parcel is clamped between the side supports by means of this connecting means whose shaft extends through the sleeve and is in locking engagement with the locking device. When said second tool is to be assembled out in the field one or more special hoisting means must be used, particularly if the coil has relatively large diameter and is so heavy that it cannot be manipulated manually.

The object of the present invention is to provide a tool intended for field use, which will eliminate the need for access to a special hoisting means to assemble the tool on a parcel having a coil of cable or line or other continuous object that is easily bent into a coil.

The invention is substantially characterized in that the side supports on one side are provided with concentric centering elements arranged to receive and center said sleeve, said side supports being designed for displacement towards each other to clamp the centered sleeve between them thereby forming said rotatable unit, that said dividing edges are arranged radially outside the centering element of the side support, the centre of the dividing edges thus dividing the distance between the centering element and the peripheral edge element of the side supports in a ratio of from 1:1 to 1:3, preferably 1:2, and that the centre of the dividing edge of the larger circle segment is arranged at a radial distance from the center of the side supports that is less than the radius of the parcel so that the dividing edge is free from contact with the support when the larger circle segment is assembled.

The invention will be described in more detail in the following with reference to the accompanying drawings.

FIGS. 1*a* and 1*b* illustrate the dismantling of a cable or line parcel and parts of a tool assembled together with the cable or line parcel, using a hoisting means according to a previously proposed method at a work place in the field to produce a rotatable unit.

FIG. 2*a* illustrates assembly of the other parts of the tool to produce the rotatable unit.

FIGS. 2*b*, 2*c* and 2*d* show the assembled, rotatable unit of the cable or line parcel and tool, FIG. 2*b* showing a second hoisting means for lifting the unit to an upright position.

FIGS. 3*a* and 3*b* show an uncoiling trestle and the unit rotatably journalled therein.

Figure 1A:
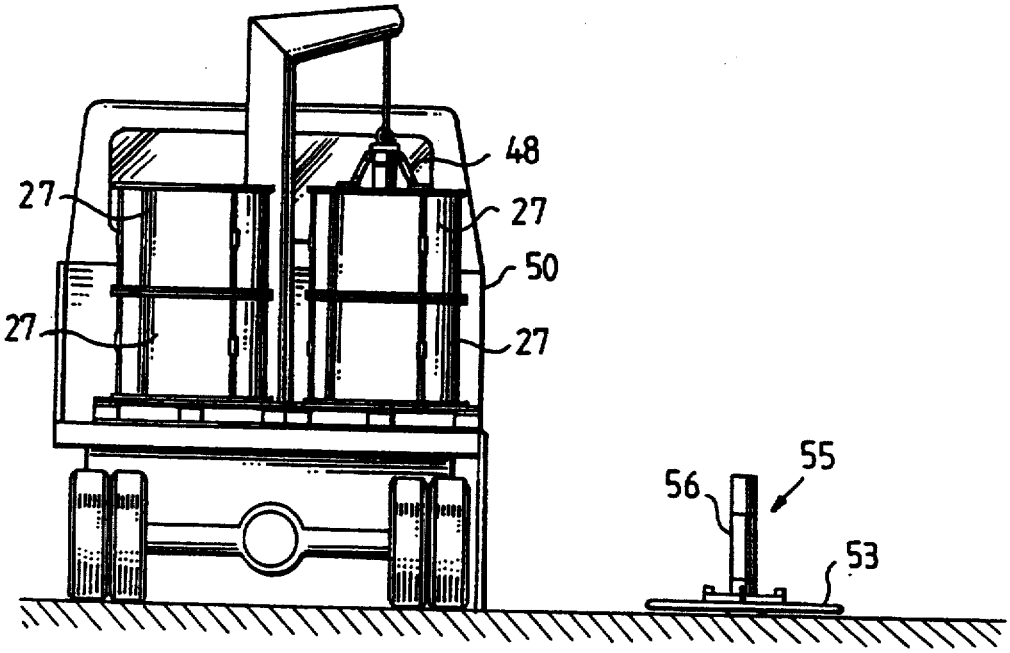
Figure 1B:
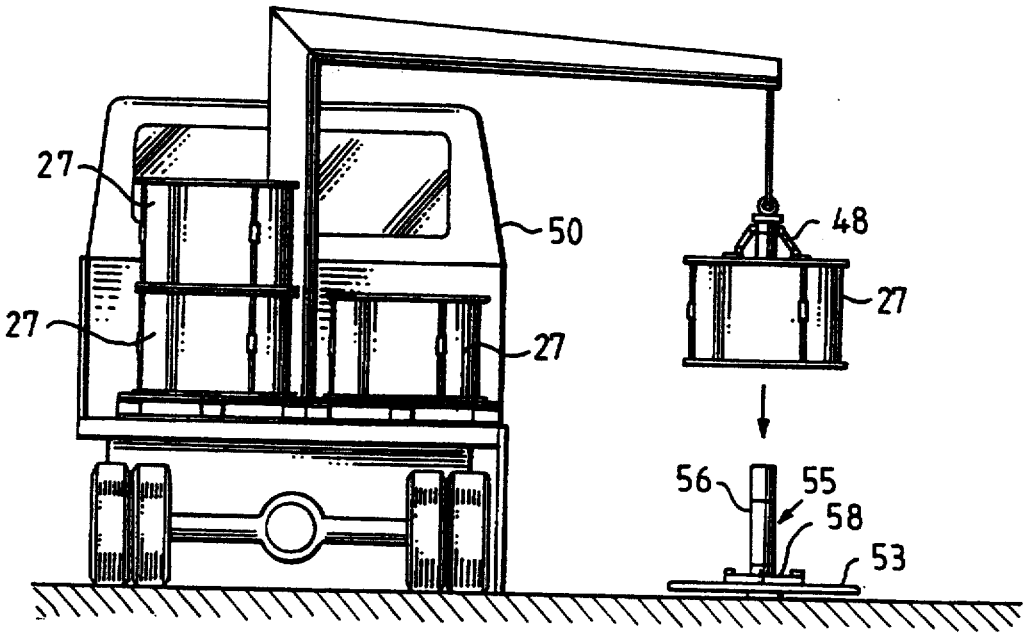
Figure 2A:
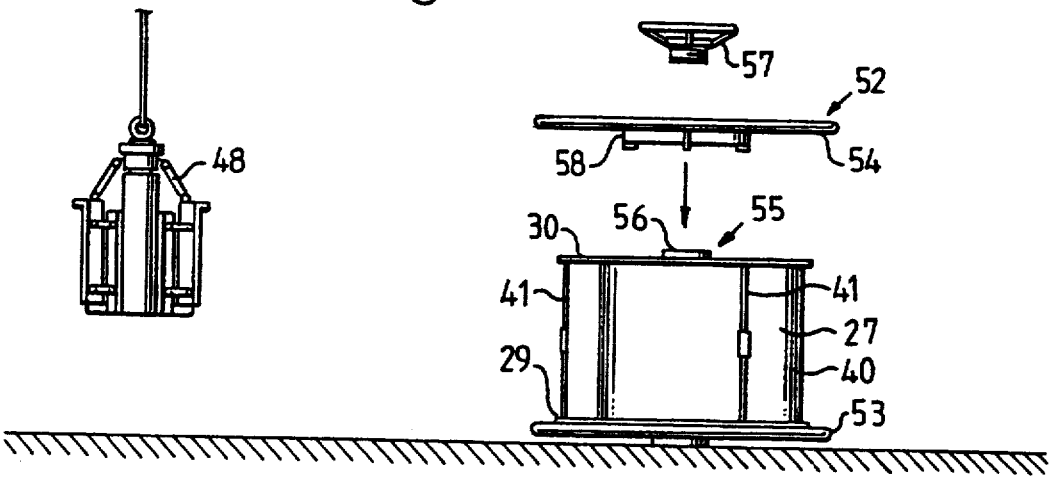
Figure 2B:
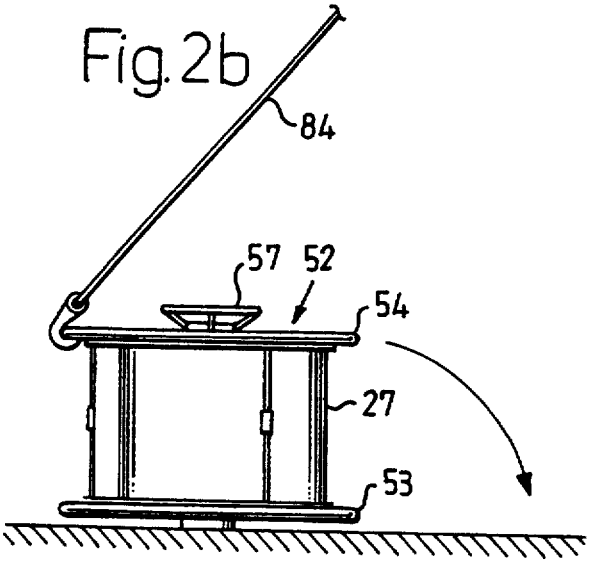
Figure 2C:
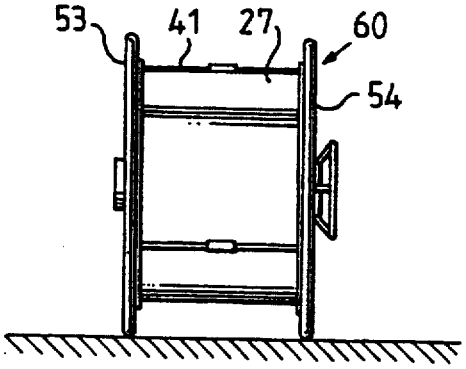
Figure 2D:
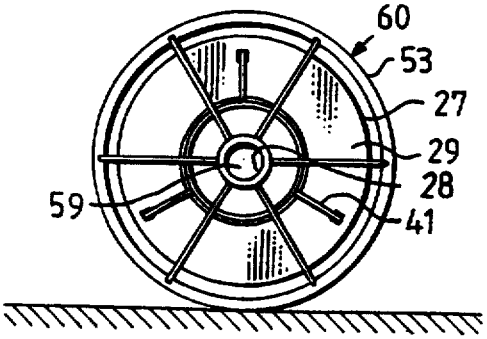

FIGS. 1 and 2 illustrate the use of two hoisting means 48, 84 for in a work place assembling a parcel 27 of cable or line, that has been delivered and contains a coil 26, said parcel being produced in the manner described in SE-9101042-1 and generally described in the introduction. The cable or line parcel 27 is thus unloaded on site from the vehicle 50 by means of an expander gripping device 48 suspended from a telescopic crane, as illustrated in FIG. 1*a*. When being unloaded, the cable or line parcel 27 can be lowered towards parts of an easily assembled and dismantled tool (see FIG. 1*b*) for repeated use in the field, which is used as a necessary aid to uncoiling the cable or line. The tool 52 is similar to the coiling machine described in the introduction and thus comprises two identical, circular, wheel-shaped, form-stable side supports 53, 54 of metal such as steel or aluminium, and an oblong connecting means 55 of metal to fix the side supports in relation to each other. The connecting means has an axial central through hole 59

Figure 3A:
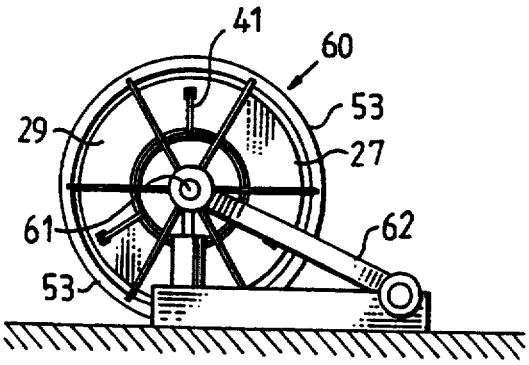
Figure 3B:
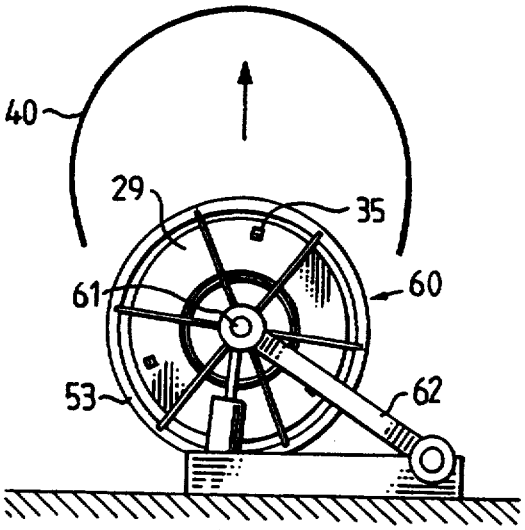
Figure 4:
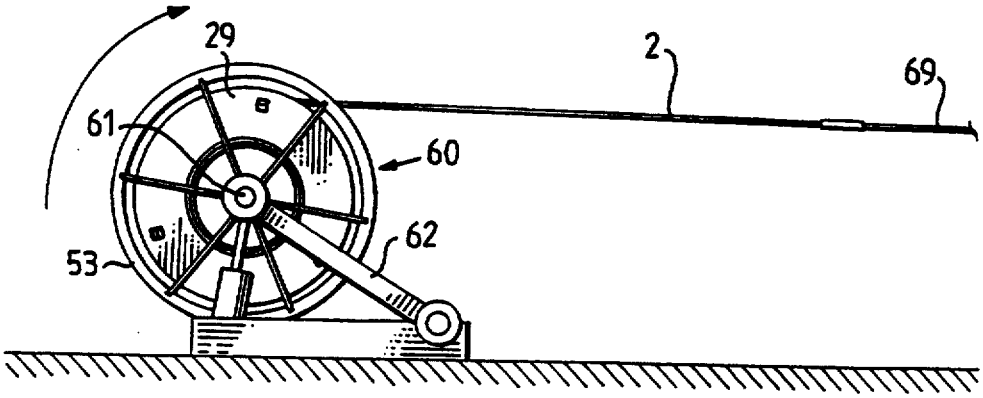
FIG. 4 shows the cable or line being uncoiled from the rotatable unit.

(see FIG. 2*d*), and consists of a hollow shaft 56 of predetermined length, a hollow locking device 57 having an external threading and a wheel to facilitate turning of the locking device 57. The shaft 56 is provided at one end with a counter flange and at its other end with an internal threading with which the threading of the locking device 57 is brought into engagement. Each side support 53, 54 comprises an outer, stable circular ring 70 of a tube, a hub 71 and a plurality of spokes 72 bearing and centering the hub 71 and defining functional openings 73 between them. The hub 71 has a central hole 74, the diameter of which is adapted to the diameter of the shaft 56 allowing the latter to be slided through the central hole 74 without clearance occurring between the sliding surfaces which might deteriorate the stability or centering. Each side support 53, 54 has an inner side with support surfaces formed by the spokes 72 and spaced from the hub 71, said support surfaces being located in a common plane parallel with the plane for corresponding support surfaces of the other side support. Each side support 53, 54 is also provided on its inner side with an axial centering element 58 concentric with the centre of the hub and having a predetermined axial length and a predetermined radius. Said support surfaces of the spokes 72 are located radially outside the centering elements 58. As can be seen from FIG. 1*a*, the shaft 56 is passed through the central hole 74 of one of the side supports and is kept vertical in that this side support 53 rests on the ground. When the parcel 27 of cable or line is lowered, its central hole 59 defined by sleeve 28 (see FIG. 2*d*) will receive the shaft 56, also received in a central space in the expander gripping device 48 so that the parcel 27 of cable or line can be lowered towards the side support 53. The expander gripping device 48 is released and removed, after which the second side support 54 is placed on top of the parcel 27 (see FIG. 2*a*) and the locking device 57 is brought into thread engagement with the shaft 56 and turned so that the parcel 27 of cable or line is clamped between the side supports 53, 54 at the same time as their centering elements 58, which may consist of whole rings as shown, center the core 28 with respect to the side supports 53, 54 so that their central axes coincide with the central axis of the sleeve and parcel 27 of cable or line. The rotatable unit 60 thus obtained is then raised to an upright position by means of a second hoisting means in the form of a wire 84 provided with hook (see FIGS. 2*b*, 2*c* and 2*d*), and is provided with an oblong journalling shaft 61 (see FIG. 3*a*), inserted through the central hole 59 of the connecting means 55. The ends of the journalling shaft 61 are placed and secured in an uncoiling trestle 62 so that the tool 52 and parcel 27 of cable or line can rotate freely on the journalling shaft 61 (see FIG. 3*a*). The bands 41 are then cut and the protective casing 40 removed, as illustrated in FIG. 3*b*, after which the free end of the cable or line 2 can be joined to one end of a traction line 69 (see FIG. 4), the other end of which is located at another remote work site to coil the traction line. When the cable or line 2 has been uncoiled, the empty second unit 60 is removed from the uncoiling trestle 62 and the tool is dismantled for re-use. The sleeve 28, protective rings 29, 30 and protective casing 40 constitute disposable packaging and are burned on site or collected.

Figure 5:
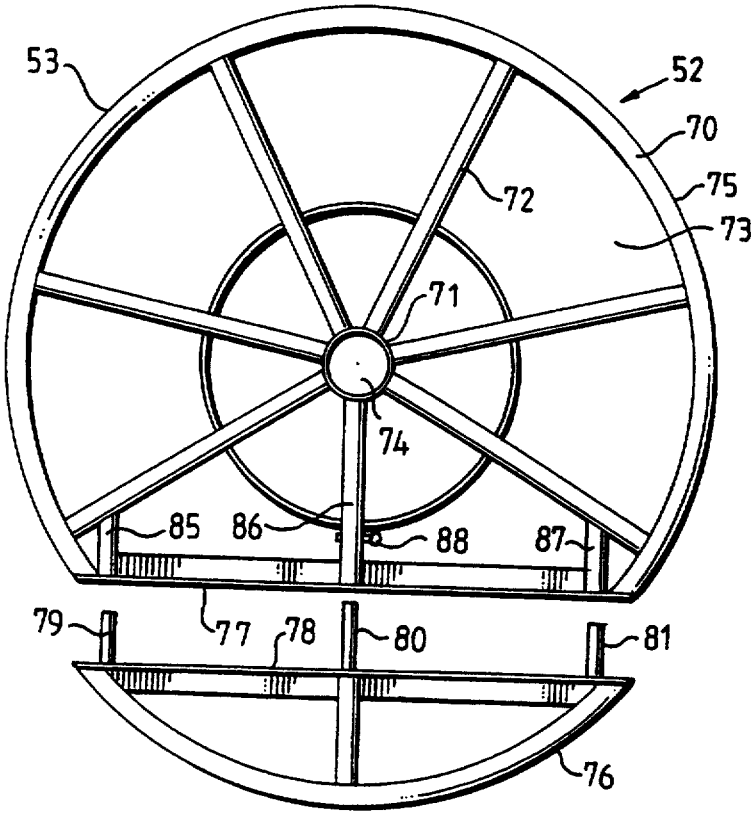
FIGS. 5 and 6 show a side view of and a section through a side support according to the present invention, that can be mounted onto a parcel of cable or line without the use of special hoisting means.
Figure 6:
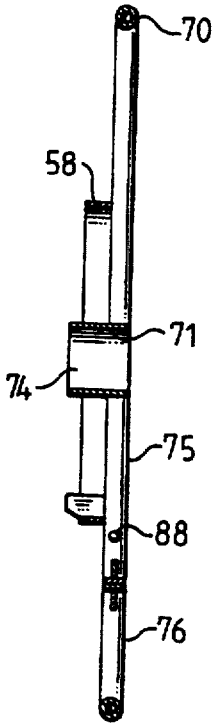
Figure 7:
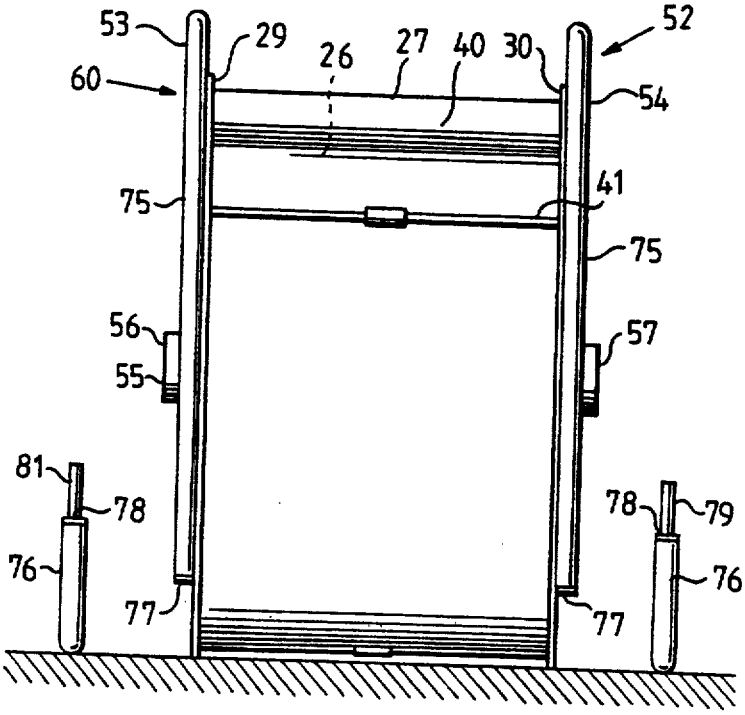
FIG. 7 shows two side supports according to FIGS. 5 and 6 during assembly of the tool on to a cable or line parcel.

FIGS. 5 and 6 show one of two identical side supports 53, 54 of a tool according to the present invention, said side supports having the same function as the side supports 53, 54 described above but being designed for assembly on an upright parcel of the type described, said parcel resting with both vertically aligned protective rings 29, 30 resting on a support, usually the ground, as illustrated in FIG. 7.

Each side support 53, 54 consists of a larger circle segment 75 and, in relation thereto a smaller circle segment 76, said circle segments having straight, parallel, stable dividing edges 77, 78, facing each other and located radially outside the centering element 58. The radial distance between the centering element 58 and the peripheral circular ring 70 of the side supports 53, 54 is divided by the centre of the dividing edges 77, 78 in a ratio of substantially from 1:1 to 1:3, preferably 1:2. In each case the radial distance between the dividing edge 77 and the centre of the side supports 53, 54 is less than the radius of the parcel 27 so that this will rest on the ground whereas the larger circle segment is free from contact with the surface of the ground. Further, the circle segments 75, 76 include cooperating coupling means and cooperating locking means. In the embodiment shown the coupling means comprise three parallel dowels 79, 80, 81 rigidly mounted to the smaller circle segment 76, perpendicular to its dividing edge 78 formed by an angle iron, and three cooperating parallel sleeves 85, 86 87, rigidly mounted to the larger circle segment, perpendicular to its dividing edge 77. The outer dowels 79, 81 and outer sleeves 85, 87 are aligned with each other immediately inside the peripheral, tubular ring 70 of the side support, whereas the middle dowel and middle sleeve 86 are aligned with each other in a common radius. The middle sleeve 86 may preferably form a part of a spoke 72 of the weel-shaped side support 53, 54 as shown in FIG. 5. When the dowels and sleeves are in engagement with each other, i.e. in operative position, they keep the circle segments 75, 76 fixed in a common plane. In the embodiment shown, the locking means comprise holes directed transversely to the radius in the middle dowel 80 and in the middle sleeve 86, and a locking pin 88 which is passed through these holes when their centre lines coincide. In this operative position, the circle segments 75, 76 are fixed to each other so that they cannot be separated. When the locking pin 88 has first been removed from said holes and the dowels then withdrawn from their sleeves, the smaller circle segment 76 is allowed to be moved from said common plane. In the embodiment shown this movement results in the smaller circle segment 76 being completely separated from the larger circle segment 75. The larger circle segment 75 can now be assembled on a specific, upright cable or line parcel 27 to abut against one protective ring 29 thereof as illustrated in FIG. 7, while the centering ring 58 of the side support enters the central sleeve of the parcel. This is not seen in FIG. 7 but corresponds to the sleeve 28 in the embodiment described first. The shaft 56 is first inserted through the central hole 74 of the side support, this being found in the larger circle segment 75, and then through the central hole of the cable or line parcel 27. The larger circle segment 75 of the side support 54 is then placed against the other protective ring 30 of the cable or line parcel, to be carried by the shaft 56. Before the locking device 57 is brought into firm engagement with the shaft 56, or when the larger circle segment 75 is being placed against the protective rings 29, 30, it should be ensured that the dividing edges 77 face towards the ground, e.g. in the optimal manner illustrated in FIG. 7 in which the dividing edges 77 are located in a horizontal plane. When said firm engagement has been achieved, the cable or line parcel is rolled in one or the other direction so that the outer ring parts 70 of the larger circle segment 75 are in contact with the ground and, upon continued rolling movement, they will carry the parcel 27, raising it from the ground. Rolling continues until the dividing edges 77 face away from the ground, e.g. obliquely or straight up, after which the smaller circle segments 76 can be assembled to the larger circle segments 75 by inserting the dowels 79, 80, 81 into the sleeves 85, 86, 87 and the locking pins 88 are brought into locking position. A sturdy rotatable unit 60 is then obtained, similar to the previously described unit 60, and can be used in the same way in an uncoiling trestle 62. According to an alternative embodiment (not shown), the coupling means form a hinged joint enabling the smaller circle segment to be swung out from and into said plane on the side of the support facing away from the centering element. The locking means are then designed in a suitable manner to fix the circle segments in the common plane they have assumed after the smaller segment is swung in. According to yet another embodiment (not shown) the coupling means are in the form of sliding rails engaging with each other for lateral displacement of the smaller circle segment in said plane in relation to the larger circle segment, the locking means then being suitably designed to fix and release the segments from each other.

The invention is also applicable to parcels of continuous objects 2 other than cable and line, such as wire, wire cable, rope, cord, ribbon, hosing, chain and similar objects that can easily be bent around a sleeve to form a coil.

I claim:

1. A tool for mounting a coil of a continuous flexible object on an axially open cylindrical sleeve around which the continuous flexible object is coiled, to form a rotatable unit, the sleeve including first and second side walls, said tool comprising:

first and second substantially identical wheel-shaped side supports, each side support having opposite faces, and comprising: a large circle segment having a peripheral extent of greater than 180°, and a small circle segment having a peripheral extent of less than 180°; said large circle segment having a substantially straight first dividing edge, and said small circle segment having a substantially straight second dividing edge for cooperating with said first dividing edge to form a complete wheel-shaped side support from said large and small circle segments; coupling means for coupling said small circle segment to said large circle segment to form a complete wheel-shaped side support; a cylindrical centering element extending from one face of said side support large circle segment, and concentric with said side support, said first dividing edge located radially outwardly from said centering element a first distance, and said second dividing edge spaced from said peripheral extent of said small circle segment a second distance, said second distance from about 1–3 times the length of said first distance; and wherein said coupling means comprise a plurality of dowels extending perpendicular to one of said dividing edges, and a plurality of sleeves adapted to receive said dowels extending perpendicular to the other of said dividing edges, said sleeves receiving said dowels when said large and small circle segments are coupled together to form a complete wheel-shaped side support.

2. A tool as recited in claim 1 wherein said second distance is about twice the length of said first distance.

3. A tool as recited in claim 1 further comprising locking means for locking said large and small segments together to form a complete wheel-shaped side support.

4. A tool as recited in claim 3 wherein said locking means comprises at least one locking pin passing through a dowel and its cooperating sleeve.

5. A tool as recited in claim 4 wherein each of said side supports includes a central hub, concentric with said cylindrical centering element, and radially inward thereof.

6. A tool as recited in claim 4 wherein said sleeves are mounted on said large circle segment, and said dowels are mounted on said small circle segment.

7. A tool as recited in claim 6 wherein said wheel-shaped side supports have radially extending spokes, and wherein one of said spokes comprises one of said sleeves, and wherein a locking pin is associated with said spoke-sleeve.

8. A tool as recited in claim 1 wherein said sleeves are mounted on said large circle segment, and said dowels are mounted on said small circle segment.

9. A tool as recited in claim 8 wherein said wheel-shaped side supports have radially extending spokes, and wherein one of said spokes comprises one of said sleeves.

10. A tool as recited in claim 1 wherein said dividing edges each have opposite ends, and wherein said coupling means comprises a coupling element adjacent one of said ends.

11. A tool as recited in claim 1 wherein each of said side supports includes a central hub, concentric with said cylindrical centering element, and radially inward thereof.

12. A rotatable unit comprising:

a coil of a continuous flexible object on an axially open cylindrical sleeve having opposite ends, and around which the continuous flexible object is coiled, the sleeve including first and second generally disc-shaped side walls having a first radius at the ends thereof; and a tool for mounting said sleeve and coil, said tool comprising: first and second substantially identical wheel-shaped side supports, one side support connected to each generally disc-shaped side wall; each side support having opposite faces, and comprising: a large circle segment having a peripheral extent of greater than 180° and a hub, and a small circle segment having a peripheral extent of less than 180°; said large circle segment having a substantially straight first dividing edge comprising a chord, and said small circle segment having a substantially straight second dividing edge comprising a chord for cooperating with said first dividing edge to form a complete wheel-shaped side support from said large and small circle segments, and a center at said hub; said complete wheel-shaped side support having a second radius from said hub to said peripheral extent, said second radius greater than said first radius; coupling means for coupling said small circle segment to said large circle segment to form a complete wheel-shaped side support; and a cylindrical centering element extending from one face of said side support large circle segment, and concentric with said side support, said first dividing edge radially outward from said centering element; and wherein the radial spacing from said hub to the closest point of said first dividing edge is less than said first radius; and wherein said coupling means comprise a plurality of dowels extending perpendicular to one of said dividing edges, and a plurality of sleeves adapted to receive said dowels extending perpendicular to the other of said dividing edges, said sleeves receiving said dowels when said large and small circle segments are coupled together to form a complete wheel-shaped side support.

13. A rotatable unit as recited in claim 12 wherein said first dividing edge located radially outwardly from said centering element a first distance, and said second dividing edge spaced from said peripheral extent of said small circle segment a second distance, said second distance from about 1–3 times the length of said first distance.

14. A rotatable unit as recited in claim 12 further comprising locking means for locking said large and small segments together to form a complete wheel-shaped side support.

15. A rotatable unit as recited in claim 14 wherein said locking means comprises at least one locking pin passing through a dowel and its cooperating sleeve.

16. A rotatable unit as recited in claim 15 wherein said sleeves are mounted on said large circle segment, and said dowels are mounted on said small circle segment.

17. A rotatable unit as recited in claim 16 wherein said wheel-shaped side supports have radially extending spokes, and wherein one of said spokes comprises one of said sleeves, and wherein a locking pin is associated with said spoke-sleeve.

18. A rotatable unit as recited in claim 12 wherein said dividing edges each have opposite ends, and wherein said coupling means comprises a coupling element adjacent one of said ends.

19. A rotatable unit as recited in claim 18 further comprising a protective casing surrounding said coil, and connected to said side walls by bands.

20. A rotatable unit as recited in claim 12 further comprising a protective casing surrounding said coil, and connected to said side walls by bands.

* * * * *